United States Patent [19]

Clerc

[11] Patent Number: 4,908,630

[45] Date of Patent: Mar. 13, 1990

[54] MEDIUM-FREQUENCY ROTATING JOINT FOR ANTENNA

[75] Inventor: Jean-Michel Clerc, Brunoy, France

[73] Assignee: Thomson-CSF, Paris, France

[21] Appl. No.: 236,242

[22] Filed: Aug. 25, 1988

[30] Foreign Application Priority Data

Aug. 28, 1987 [FR] France ..... 87 12038

[51] Int. Cl.[4] ..... H01Q 3/02; H01P 1/06

[52] U.S. Cl. ..... 343/763; 343/758; 333/261

[58] Field of Search ..... 343/763, 758, 762; 333/24 C, 256, 257, 261

[56] References Cited

U.S. PATENT DOCUMENTS 4,543,549 9/1985 Meltzer et al. ..... 333/256

FOREIGN PATENT DOCUMENTS 0180213 5/1986 European Pat. Off. .

1191485 11/1959 France .

*Primary Examiner*—Rolf Hille

*Assistant Examiner*—Doris J. Johnson

*Attorney, Agent, or Firm*—Cushman, Darby & Cushman

[57] ABSTRACT

Disclosed is a rotating joint used in radars to transmit electrical signals on several channels between a rotating antenna and a fixed support. The pass-band of the matched and coupled circuits of each channel is substantially improved by making these circuits on concentric, circular rings which have metallic ground strips deposited on both faces, said strips being connected by metallized holes, and metallic strips of coils connected by the facing sections of the rings.

12 Claims, 4 Drawing Sheets

MEDIUM-FREQUENCY ROTATING JOINT FOR ANTENNA

BACKGROUND OF THE INVENTION

The invention concerns rotating joints used to transmit medium frequency or intermediate frequency signals between a rotating antenna and its support which is fixed, and especially rotating joints used in radar antennas.

Many radars use rotating antennas which are designed to first emit high-powered signals at very high frequencies and then to receive signals reflected by objects, these signals being very low-powered. Before these signals are processed in order to extract the information that they contain, they are first amplified to very high frequency and then transposed to a medium or intermediate frequency of about 60 megahertz at which they are again amplified. These different frequency amplification and transposing operations are performed on the antenna itself in a part of the radar called the "R.F. head". For the signals to be transmitted from the "R.F. head", which is on a rotating support, to the signal processing device itself, which is placed on a fixed support at a certain distance from the antenna, it is necessary to provide for a rotating joint which does this transmission.

Depending on the characteristic of the radar and, hence, of the radar antenna, the signals of several parallel reception channels should be transmitted simultaneously without the channels interfering with one another: this means that they should be insulated or decoupled by suitable shielding.

Broadly speaking, a prior art rotating joint has two cylindrical parts which are arranged concentrically and are hinged by means of ball bearings so that they rotate with respect to each other. These two parts are separated on a certain length by a ring-shaped space which is designed to accommodate several pairs of matched circuits, each corresponding to a reception channel. Each pair of matched circuits consists of two concentric, flat rings, the small ring being solidly joined to the internal cylindrical part and the big ring being solidly joined to the external cylindrical part. To make the coil of each matched circuit, a metallic strip is deposited on the same side of each ring, in following its internal and external rims, said strip being configured so as to form an open electrical winding, the ends of which are designed to receive appropriate external connections. Thus, one end is connected to the ground by means of the metallic strip placed on the internal rim of the small ring and on the external rim of the big ring, while the other end is connected to a coaxial conductor. By this mechanical and electrical arrangement, only the parts facing the metallic strip of each ring each constitute a coil of the matched circuit. The capacitors of the matched circuits result from the distributed capacitance of the windings and the addition of a capacitor with a defined capacitance.

The signal to be transmitted is applied to the ends of a matched circuit of one ring of a pair and is transmitted by a mutual inductance effect to the ends of the matched circuit of the other ring of the pair. Since the rings are concentric, this transmission takes place regardless of their respective angular positions.

To set up several channels, several pairs of rings are stacked, while being separated by shields also consisting of pairs of rings, the spacing between the rings of the pairs of matched circuits and the rings of the shields being obtained by spacers. These spacers are metallic and are in contact, firstly, with the concentric cylindrical parts of the rotating joint and, secondly, with the internal rim of the small ring and the external rim of the big ring. These different contacts constitute the electrical ground connection which is reinforced by screws that fix these spacers to the corresponding cylindrical parts of the rotating joint.

The rotating joint that has just been described has a number of drawbacks. Firstly, the pass-band of the channels is at more than 20 megahertz with attenuation of three decibels, and the insertion loss is about half a decibel. A limitation of this kind is incompatible with the characteristics required for modern radars.

Furthermore, the stacking of a large number of spacers requires high precision in their making and assembly because it is important for the rings of a pair not to have their position shifted because this would result in lower mutual inductance. This problem is all the more difficult to resolve as the number of channels is great, as is the case with modern radar installations where the rotating joint is often designed for twelve channels in parallel. Furthermore, the thickness of the spacers is such that it leads to the rotating joint having dimensions close to one meter.

Again, the ground link is poorly established because the metallic ribbon is deposited on only one side of the ring and is, therefore, in contact only with the spacers on the same side and these spacers are, moreover, connected to the ground of the rotating joint by fastening screws.

SUMMARY OF THE INVENTION

An aim of the present invention, therefore, is to make a rotating joint, the different channels of which have a pass-band which is as high as possible and is, in particular, greater than 45 megahertz, with an insertion loss which is as low as possible.

Another aim of the present invention is also to make a rotating joint with a space factor which is as small as possible while having a large numbers of channels.

Yet another aim of the present invention is to make a rotating joint which is simpler and easier to make than the prior art rotating joint.

The invention relates to a rotating joint to transmit signals between a rotating antenna and its fixed support, comprising two concentric parts which are hinged so as to rotate with respect to each other and which are separated over a certain length by a ring-shaped space, said ring-shaped space being designed to accommodate a stack of pairs of concentric, rings separated by pairs of spacers so as to define several pairs of matched and coupled circuits and circuits which are shielded from one another, wherein the rims facing the rings of a pair have first ring-shaped metallic strips on their two faces, said metallic strips being electrically connected so as to make an open-ended coil winding.

The electrical connection of the metallic strips of the open-ended coil winding is made by the section of the ring in the form of a metallic strip.

The rims of the rings that do not face each other have ring-shaped metallic strips on both their faces. These ring-shaped metallic strips are electrically connected by metallized holes so as to make a closed winding which acts as a ground contact.

Each separating spacer between the matched circuits has a radial extension in the form of a ring which constitutes a shielding screen.

Each separating spacer has a circular groove to house a metallic braid which provides electrical connection between the spacer and the associated concentric part.

BRIEF DESCRIPTION OF THE DRAWINGS

Other features and advantages of the present invention will appear from the following description of a special embodiment, said description being made with respect to the appended drawings, of which.

DESCRIPTION OF THE PREFERRED EMBODIMENTS

Figure 1:
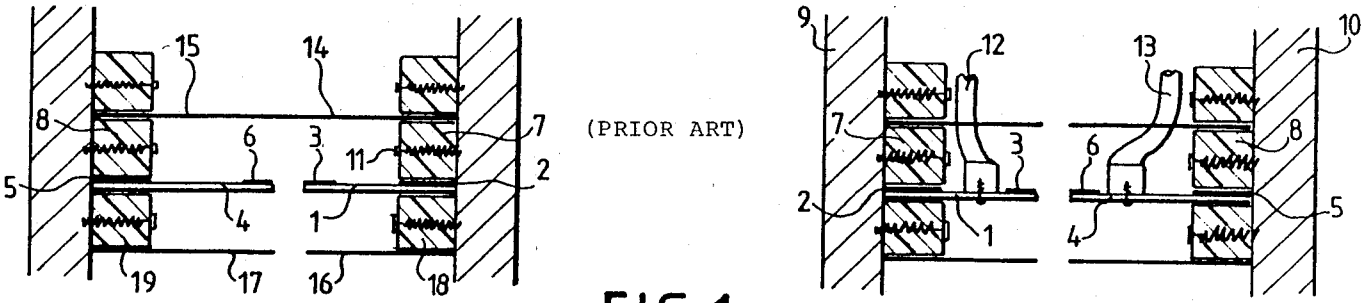
(PRIOR ART) FIG. 1
FIG. 1 is a schematic and partial sectional view of a rotating joint limited to two coupled circuits and their associated shield made according to prior art techniques.

In FIG. 1, the coil of a first matched circuit consists of a small, flat circular ring 1 which has, on a single side, a first metallic strip 2 placed on its internal rim and a second metallic strip 3 placed on its external rim. The coil of a second matched circuit consists of a big ring 4 bearing, on the same side as that of the small coil, a small metallic strip 5 placed on its external rim and a second metallic strip 6 placed on its internal rim. The metallic strips 2 and are connected to the ground potential by spacers 7 and 8 which lie on the said strips. One of these spacers 7 and 8 is fixed to an internal cylindrical part 9 while the other is fixed to an external cylindrical part 10, by screws 11. The facing metallic strips 3 and 6 are respectively connected to coaxial conductors 12 and 13.

Figure 2:
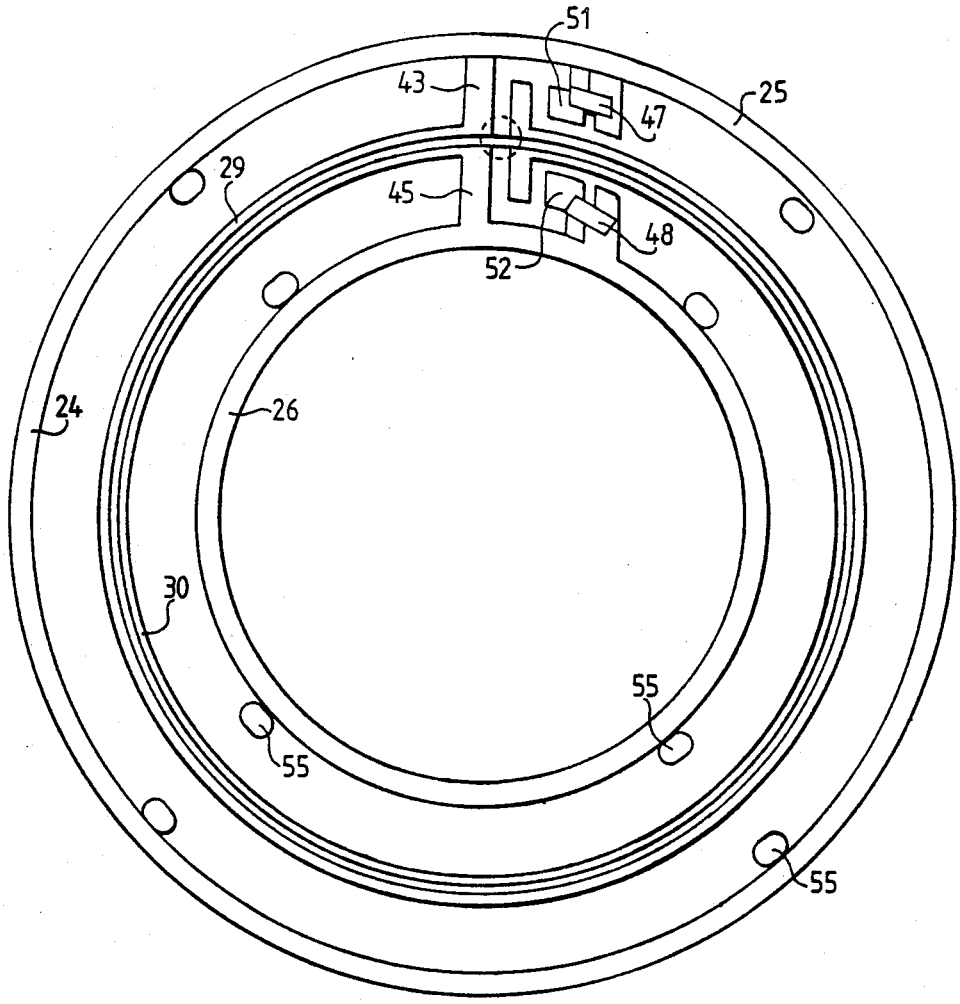
FIG. 2 is a top view of the coils of two coupled circuits made according to the invention.
Figure 3:
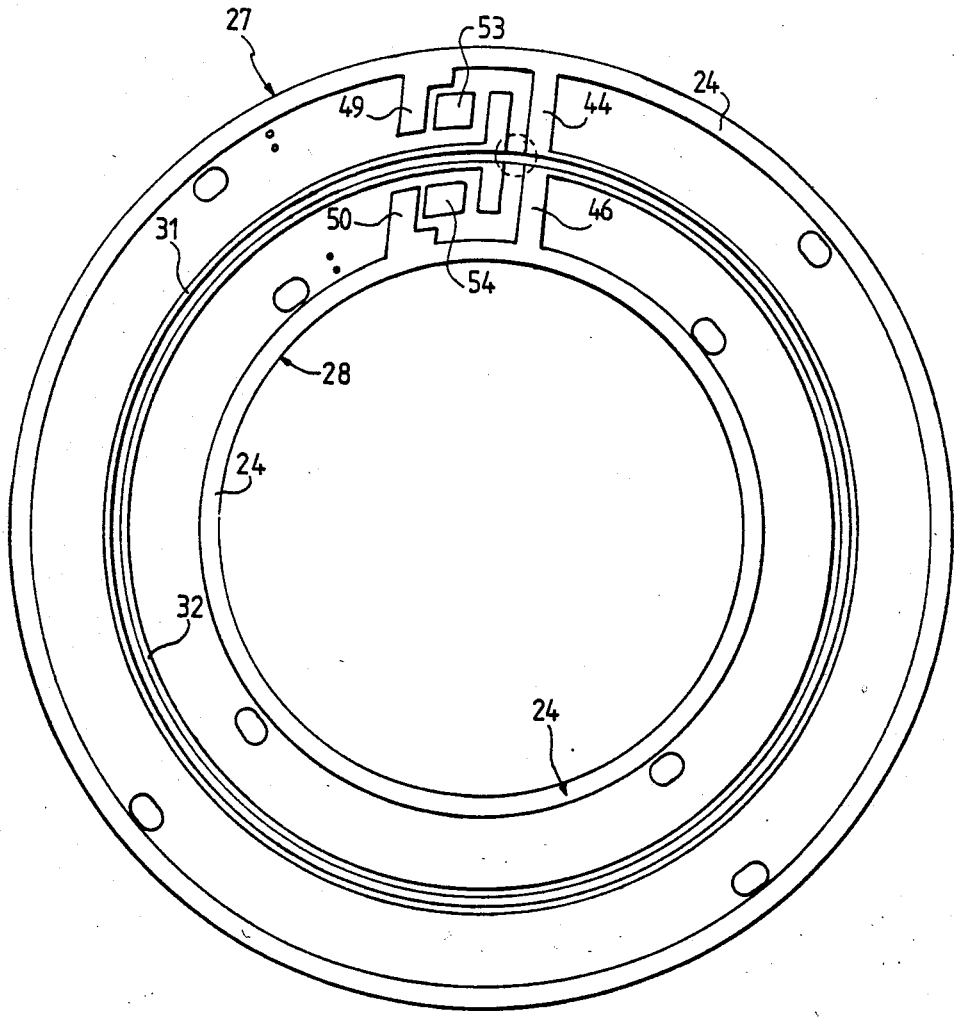
FIG. 3 is a bottom view of the coils of two coupled circuits made according to the invention.

It must be noted that, as shall be described with respect to FIGS. 2 and 3, the metallic strips 3 and 6 are open and one of their ends is connected to the ground metallic strip 2 or 5 borne by the same ring so as to make the ground terminal of the coil. It is thus the metallic strips 3 and 6 that each form a coil of each matched circuit, with the two coils forming a mutual coupling because of their facing position.

The spacers 7 and 8 support two concentric, metallic flat rings 14 and 15 which form a first shielding. A second shielding is made by two other concentric, metallic, flat rings 16 and 17, separated from the rings 1 and 4 by spacers 18 and 19 on which these rings rest.

As shall be described further below with reference to FIG. 5, the internal cylindrical part 9 and the external cylindrical part 10 are concentric and are connected from top to bottom by a ball-bearing type device so that they rotate with respect to each other in such a way that the different external rings 4, 15, and 17, rotate around the internal rings 1, 14 and 16.

According to the present invention, it is proposed to modify the arrangement of the metallic strips on the rings 1 and 4, the making of the spacers, the shielding rings 14 to 17, and the ground contact between the spacers and the passage of the coaxial conductors.

Figure 4:
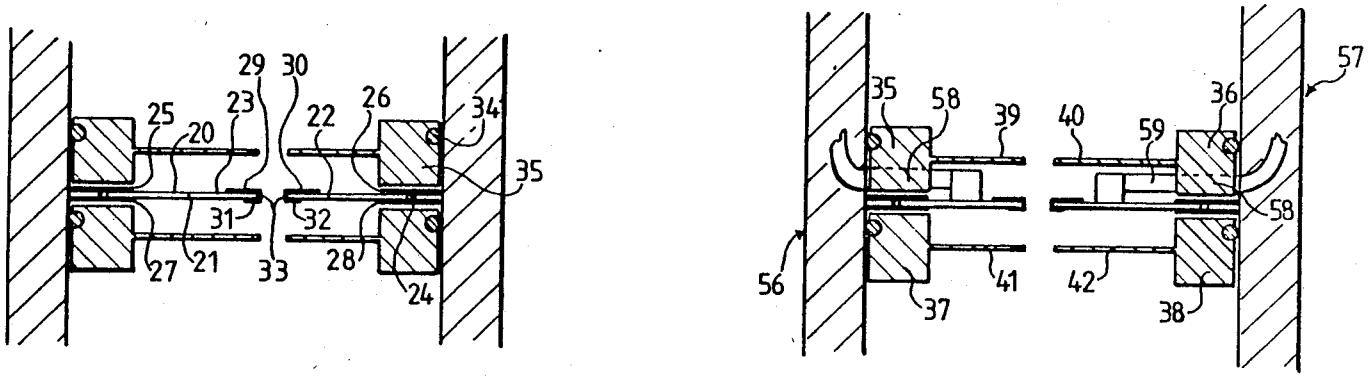
FIG. 4 is a schematic and partial sectional view of a rotating joint, limited to two coupled circuits and their associated shield, which are made according to the invention, and, FIG. 5 is a sectional view of a rotating joint according to the invention designed to transmit 12 channels.

To improve the characteristics of the matched circuits, the metallic strips 25, 26, 27 and 28, which form the ground contact, are placed on the two faces 20 and 21 of the concentric flat rings 22 and 23 (FIGS. 2, 3 and 4) made of epoxy resin, and are linked to one another by metallized holes 24. The same is true of the metallic strips 29, 30, 31 and 32 which form the mutually coupled in this case, the width of the metallic strips 31 and 32 is smaller than that of the strips 29 and 30 and the electrical connection between the strips 29 and 31, on the one hand, and 30 and 32, on the other, is made by a metallic deposit on the sections 33 of the facing edges. For example, the width of the strips 29 and 30 may be about two millimeters while that of the strips 31 and 32 is about half a millimeter. In the same example, the width of the ground strips 25 to 28 may be about five millimeters.

Furthermore, the ground contact is improved between the spacers and the supporting cylindrical parts by a metallic braid 34 which is housed in a circular groove of the spacers 35 to 38. These spacers are designed to form, at the same time, both the spacing between the supporting rings of the matched circuits and the concentric metallic screens 39 to 42. The result of this is that the number of parts to be assembled by stacking is reduced and the adjustment of their thickness to align the rings in one and the same plane is easier.

The top and bottom views shown in FIGS. 2 and 3 respectively show the arrangement and appearance of the metallic strips which surround the rings so as to form the coils of the matched circuits and the ground contact. In these figures, the ground strips 25 and 27 are connected to the strips 29 and 31 forming the external coil by arms 43 and 44. The same is true of the ground strips 26 and 28 which are connected to the strips 30 and 32 forming the internal coil by arms 45 and 46. It is observed that the ground metallic strips are closed while the strips of the coils are open-ended at the location of the arms 43 to 46 over a distance of a few millimeters. To make the different electrical connections, the metallic strips are extended radially by arms 47 to 50 which are connected, from one face to the other, by metallized holes. For these connections, there is also provision for metallized surfaces 51 to 54 which are connected, from one face to the other, by metallized holes. These arms and metallized surfaces are used, of course, for the connection of the input and output coaxial conductors but also for the connection of the capacitors to obtain the matching of circuits with the chosen frequency.

The internal and external rings are each perforated with four holes 55 used for the coaxial conductors to go through: the number of these holes is four when there are four reception channels. For twelve reception channels there should be twelve holes of this type for the coaxial conductors to pass not only through the twenty-four rings but also through the metallic shielding screens. These holes 55 weaken the resistance of the rings and the shielding effect of the screens. However, these holes 55 can be kept to provide for interchangeability with rotating joints installed according to the prior art.

To avoid the presence of these holes, the invention proposes to make these coaxial conductors 59 go into the walls 56 and 57 of the supporting concentric, cylindrical parts through holes 58 (FIG. 5) drilled in the spacers and hollow, longitudinal grooves in the walls of the internal cylindrical and external cylindrical parts 60 and 61 respectively.

Figure 5:
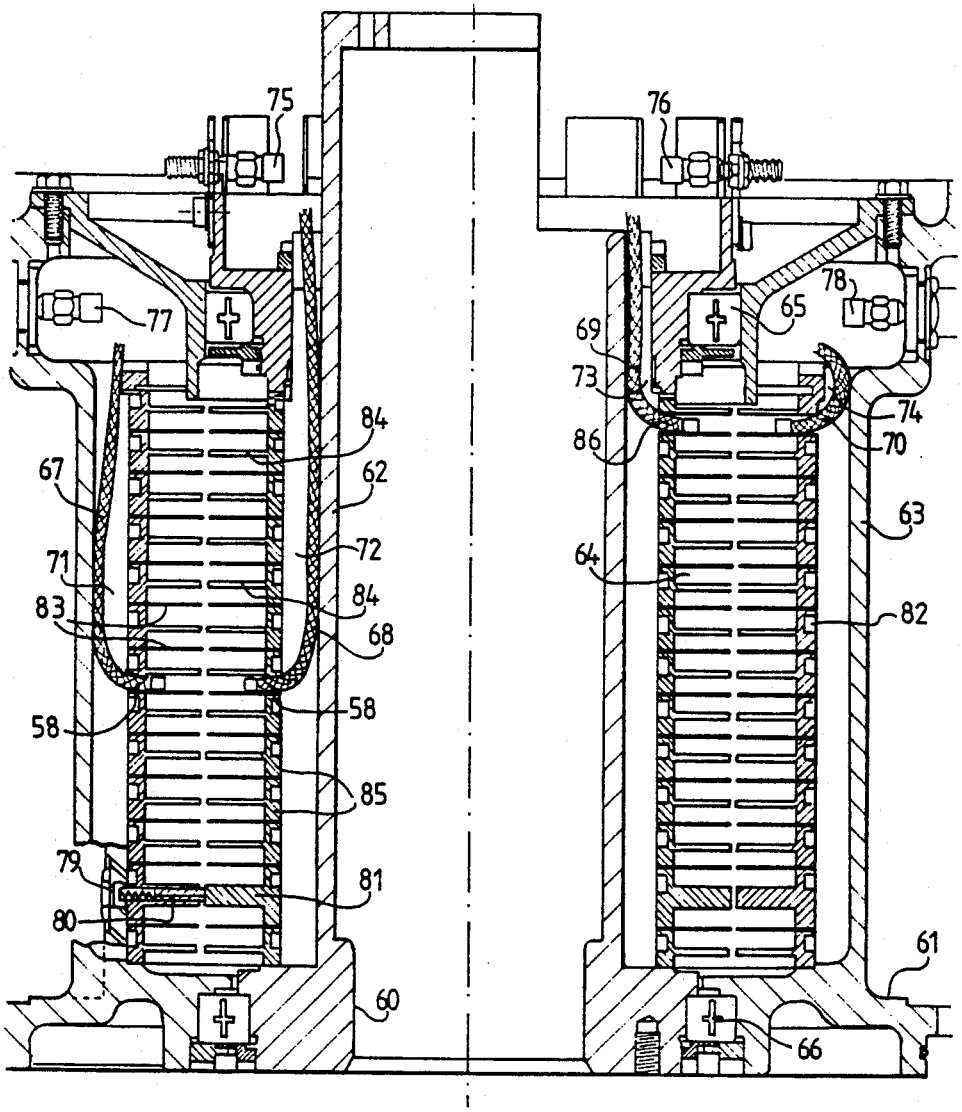

The sectional view of FIG. 5 shows a rotating joint designed for twelve reception channels. As already shown, it comprises an internal cylindrical part 60 and an external cylindrical part 61 which define, between their walls 62 and 63, a ring-shaped space 64 in which are housed the twelve pairs of concentric rings 83 which support the matched circuits and the twelve pairs of concentric rings 84 and spacers 85 which constitute the shielding screens. These cylindrical parts 60 and 61 are concentric and they rotate with respect to each other by means of an assembly of ball bearings 65 and 66 which are placed at the bottom and top of the ring-shaped space 64. For the passage of the coaxial conductors 67 to 70, the walls 62 and 63 have grooves 71 to 74 which open out into the upper part of the rotating joint to be connected to input pins 75 and 76, fixed to the internal cylindrical part 60 and output pins 77 and 78, fixed to the external cylindrical part 61.

The rotating joint has a ground terminal 79 placed on the external cylindrical part 61. This ground terminal is provided with a carbon and spring device 80, the carbon of which comes into contact with a thick metallic spring 81 which is electrically connected with the internal cylindrical part 60.

As already indicated, the different rings are mounted in the ring-shaped space by stacking, and it is provided that the surfaces of the straps in contact will be trued to align each pair of rings in one and the same plane.

The pairs of rings forming the matched circuits that are coupled with one another are manufactured, for example, according to techniques for making printed circuits, from a single epoxy glass wafer on which a gap of one millimeter is cut out between the internal and external rings, except at the place where there is no metallization. It is on this wafer that the various operations are performed to obtain the pattern of the metal strips shown in FIGS. 2 and 3. When these operations are over, the final trimming operations are completed by internal cutting of the small coil and external cutting of the big coil.

With the different improvements provided by the invention, it is possible to make matched and coupled circuits having a pass-band of at least 45 megahertz with attenuation of three decibels, a pass-band at least 30 megahertz attenuation of half a decibel and a pass-band of at least 20 megahertz with attenuation of one-tenth of a decibel, while the insertion loss is smaller than one-tenth of a decibel.

Furthermore, the operations for the manufacture and assembly of the different elements forming the rotating joint are easier to perform while, at the same time, being more precise. This enables the making of a rotating joint with a large number of channels in a relatively small volume.

What is claimed is:

1. A rotating joint to transmit signals between a rotating antenna and its fixed support, comprising:

two cylindrical, concentric parts which are assembled to be rotatable with respect to each other, and which are separated over a certain length by a ring-shaped space;

a stack of pairs of concentric, coplanar flat insulating rings, disposed in said ring-shaped space, said pairs of rings being separated by pairs of spacers, wherein each ring of a pair comprises two faces, the first faces including first ring shaped to the other ring of said pair, and the second faces including second ring shaped metallic strips along rims of said second faces which are nearest to the other ring of said pair and wherein said rims of said two faces which are the nearest to the other ring of said pair include means for connecting strips of the two faces of a ring, so as to form an open-ended coil winding, to form the rotating joint thus having pairs of matched and inductively coupled circuits which are shielded from one another.

2. A rotating joint according to claim 1, wherein the rims of the two faces of each ring of a pair which are opposite to the other ring of said pair comprise third ring-shaped metallic strips, said third strip of the two faces of a ring being electrically connected, so as to form a closed winding used as a ground contact.

3. A rotating joint according to claim 1, wherein said first and second ring-shaped metallic strips of a ring of a pair of connected by means of a fourth metallic strip deposited on the section of the rim of said ring which faces the other ring of said pair.

4. A rotating joint according to claim 2, wherein said third ring-shaped metallic strips of a ring are connected by means of metallized holes drilled through the thickness of said ring.

5. A rotating joint according to claim 1, wherein the first ring-shaped metallic strip of a face of a ring has a width which is about two millimeters, whereas the second ring-shaped metallic strip of the other face of the same ring has a width which is half a millimeter.

6. A rotating joint according to claim 2, wherein each of said third ring-shaped metallic strips has a width which is about five millimeters.

7. A rotating joint according to claim 2, wherein said rings are made of an insulating material and wherein said first, second and third ring-shaped metallic strips and the associated connections are obtained by depositing.

8. A rotating joint according to claim 1, wherein each of said spacers is ring-shaped, is placed against one of said cylindrical concentric parts and comprises an also ring-shaped radial extension which constitutes a shielding screen.

9. A rotating joint according to claim 8 wherein each of said spacers has a circuit groove to house a metallic braid which makes an electrical contact between this spacer and the cylindrical part against which it is placed.

10. A rotating joint according to claim 1 wherein said rings have openings for connection conductors to pass through.

11. A rotating joint according to claim 1, wherein each of said spacers has at least one radial opening for a connecting conductor to pass through.

12. A rotating joint according to claim 11 wherein the walls of said ring-shaped space have longitudinal grooves for the connecting conductors to pass through.

* * * * *